US011421162B2

(12) United States Patent
Pradeep et al.

(10) Patent No.: US 11,421,162 B2
(45) Date of Patent: Aug. 23, 2022

(54) PROCESS FOR CO-CONVERSION OF WASTE PLASTICS AND HYDROCARBON FEEDSTOCK

(71) Applicant: Indian Oil Corporation Limited, Mumbai (IN)

(72) Inventors: Ponoly Ramachandran Pradeep, Faridabad (IN); Prantik Mondal, Faridabad (IN); Shivam Ashok Dixit, Faridabad (IN); Shikha Saluja, Faridabad (IN); Shakti Singh, Faridabad (IN); Terapalli Hari Venkata Devi Prasad, Faridabad (IN); Satyen Kumar Das, Faridabad (IN); Madhusudan Sau, Faridabad (IN); Gurpreet Singh Kapur, Faridabad (IN); Sankara Sri Venkata Ramakumar, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 0 days.

(21) Appl. No.: 17/391,933

(22) Filed: Aug. 2, 2021

(65) Prior Publication Data

US 2022/0041940 A1 Feb. 10, 2022

(30) Foreign Application Priority Data

Aug. 5, 2020 (IN) ..... 202021033558

(51) Int. Cl.

| | |
|---|---|
| ***C10B 47/24*** | (2006.01) |
| ***C10G 11/18*** | (2006.01) |
| ***C10G 1/10*** | (2006.01) |

(52) U.S. Cl.

CPC ..... *C10G 11/182* (2013.01); *C10G 1/10* (2013.01); *C10G 2300/1003* (2013.01); *C10G 2300/1074* (2013.01); *C10G 2300/4006* (2013.01); *C10G 2300/4012* (2013.01); *C10G 2300/4056* (2013.01); *C10G 2300/4093* (2013.01); *C10G 2400/02* (2013.01); *C10G 2400/20* (2013.01); *C10G 2400/28* (2013.01)

(58) Field of Classification Search

CPC ..... C10G 1/086; C10G 11/182; C10G 2300/1003; C10G 2300/4006; C10G 2300/4012; C10G 2300/4093; C10B 47/24; B01J 2219/00006

See application file for complete search history.

(56) References Cited

U.S. PATENT DOCUMENTS

| | | | | |
|---|---|---|---|---|
| 4,108,730 | A * | 8/1978 | Chen | C10B 53/07 201/2.5 |
| 5,364,995 | A | 11/1994 | Kirkwood et al. | |
| 6,534,689 | B1 | 3/2003 | Stankevitch | |
| 8,350,104 | B2 | 1/2013 | Fujimoto et al. | |
| 2014/0228606 | A1 * | 8/2014 | Narayanaswamy | C10G 69/08 585/241 |

* cited by examiner

*Primary Examiner* — Randy Boyer
(74) *Attorney, Agent, or Firm* — Workman Nydegger

(57) ABSTRACT

The present invention relates to a process for converting the waste plastics along with the petroleum feedstock in a Catalytic Cracking Unit, in particular a Fluid Catalytic Cracking Unit employed in petroleum refineries. The invention also provides a method and hardware system to enable waste plastic to fuel conversion along with hydrocarbon catalytic cracking. The invented process aims to convert any type of waste plastic including polystyrene, polypropylene, polyethylene, metal containing Polyethylene-Polypropylene multilayer plastics & other metal containing plastics along with the petroleum derived feedstock such as vacuum gas oil, reduced crude oil, vacuum residue etc. in catalytic cracking unit.

11 Claims, 1 Drawing Sheet

PROCESS FOR CO-CONVERSION OF WASTE PLASTICS AND HYDROCARBON FEEDSTOCK

FIELD OF THE INVENTION

The present invention relates to a process for converting the waste plastics along with the petroleum feedstock in a Catalytic Cracking Unit, in particular a Fluid Catalytic Cracking Unit employed in petroleum refineries.

BACKGROUND OF THE INVENTION

Issue of waste plastic disposal has been a grave concern worldwide and in India in particular, with staggering 26000 tons of waste plastic being generated every day. Use of disposal methods such as landfill suffer from issues like groundwater contamination, land use pattern etc. incineration of plastics cause air pollution hampering the health of flora and fauna. With the increased awareness of public regarding cleanliness of public places and waste segregation, it is becoming increasingly possible to collect and segregate waste plastics from rest of the waste material in India. Specifically, there is no effective recycling or processing option for metal containing Polyethylene and Polypropylene multi-layer plastics films. There have been several initiatives in the prior art for processing of waste plastics to produce hydrocarbon fuels.

U.S. Pat. No. 5,364,995 describes a process for converting waste plastics to lower hydrocarbons in a fluidized bed of inert solid particulate materials heated to desired temperature. Option for using alkaline solids for trapping of acidic gases is also provided for additional process safety.

U.S. Pat. No. 6,534,689 describes a process for catalytic Pyrolysis of shredded waste plastics in a downflow fluidized bed reactor using a continuous circulating fluidized bed configuration. Inter particles are circulated in the unit to supply the necessary heat required for waste plastic pyrolysis. The Pyrolysis products are quenched to recover the liquid for further use.

U.S. Pat. No. 8,350,104 describes a method and apparatus for catalytic cracking of waste plastic material using an externally heated horizontal cylindrical reactor vessel. The waste plastics are mixed with cracking catalysts at a reaction temperature range of 350–500° C. in a reactor vessel. The reaction products are condensed and recovered.

The prior art processes are focused on the conversion of waste plastics employing multiple techniques wherein the waste plastic is a single feedstock for these processes. It is also observed that there is a drawback in setting up stand-alone waste plastic conversion units due to the need for treatment facilities for the products coming out of these units, which are not economical to set up in small scales. This results in several of the products generated from stand-alone waste plastic conversion processes not meeting the desired product specifications in the market. This problem is aggravated due to the widely varying qualities of waste plastics in terms of molecular composition, impurity levels etc. It is therefore our conviction that it is highly desirable and need-of-the-hour to have a process for conversion of waste plastics to fuel, which can integrate with the existing process units of petroleum refineries, wherein the products of conversion of waste plastics can be mixed with the regular petroleum refining products and undergo the effective product treatment in the treatment units. None of the prior arts provides an efficient and effective process for converting waste plastics to fuel within the petroleum refineries addressing the real-life issues.

Meanwhile interestingly, it has been observed in the fluid catalytic cracking unit—one of the prominent process units employed in petroleum refinery for catalytic cracking of vacuum gas oil range heavy hydrocarbon materials to lighter hydrocarbons, that there is a bottleneck being faced in the operation of regenerator at high temperature while operating the unit at high severities and higher coke yields. This problem is mainly due to the excess heat generated in the regenerator while burning off the excessive coke which is generated while processing of heavy feeds. This excess heat in the regenerator results in reduction in the hot regenerated catalyst flow into the riser reactor, since the set point of the riser outlet temperature controls the flow rate of the regenerated catalyst withdrawn from the regenerator vessel. When the fluid catalytic cracking unit is desired to be operated at high severities, this excess heat is desired to be removed by means of installing a 'catalyst cooler' in the regenerator. In view of these, it is desired to have a process which can address the issue of heat management in fluid catalytic cracking as well as enable effective conversion of waste plastic to fuel within the petroleum refinery.

OBJECTIVES OF THE PRESENT INVENTION

It is a primary objective of the invention to provide a catalytic cracking process, used to catalytically crack petroleum residues from crude oil refining processes into valuable light distillate products.

It is the main objective of the present invention is to provide the process for co-conversion of waste plastics, including metal containing multilayer plastics along with petroleum derived feedstock into valuable lighter distillate products in a Fluid Catalytic Cracking Unit.

Another objective of the present invention is to provide a unique process hardware scheme to feed the waste plastic into the FCC directly.

It is yet another objective of the present invention is to enable treatment of the reaction products of waste plastic catalytic conversion along with the products generated from hydrocarbon catalytic cracking to ensure product quality.

Another objective of the present invention is to utilize the excess thermal energy of hot regenerated catalyst in high severity FCC units to enable thermal and catalytic cracking of the waste plastics to valuable lighter hydrocarbons like light olefins, LPG, gasoline etc.

SUMMARY OF THE PRESENT INVENTION

The present invention discloses a synergistic co-conversion of waste plastics along with hydrocarbon feedstock through a catalytic cracking unit.

In a preferred aspect of the present invention discloses a method for co-conversion of plastics and hydrocarbons into lighter distillate products, the method comprising of:

a) spray feeding hydrocarbon feed (30) in the bottom section of the riser reactor (32) through the injection nozzles (31);
b) feeding hot regenerated catalyst from the regenerator vessel (45) into the bottom section of the riser reactor to allow contacting with hydrocarbon feed;
c) feeding a lift fluidization media (33) into the bottom section of the riser reactor (32);
d) conveying the waste plastic from the supply vessel to the bottom section of riser, to allow thermal decomposition and catalytic cracking of plastic material into lighter molecules by contacting with the catalyst particles during the upward motion through riser reactor;

e) separation of catalyst and product vapors (42) by means of riser termination devices;

f) separation of hydrocarbon molecules from the catalyst by steam stripping in the stripper vessel (18); and g) separation of product vapors (22) into different product fractions like naphtha, light cycle oil, heavy cycle oil, clarified oil etc., by fractionator column.

In another aspect of the present invention a method for co-conversion of plastics and hydrocarbons into lighter distillate products is disclosed wherein the waste plastic is optionally pre-processed by steps comprising of washing, drying, extrusion, pelletization etc., and the waste plastics in the vessel is optionally in fluidized conditions.

In another aspect of the present invention a method for co-conversion of plastics and hydrocarbons into lighter distillate products is disclosed wherein the waste plastic is selected from the group consisting of polystyrene, polypropylene, polyethylene, PET including metal additized multilayer plastics or combination thereof.

In another aspect of the present invention a method for co-conversion of plastics and hydrocarbons into lighter distillate products is disclosed wherein the physical form of waste plastic is selected from the group consisting of granules, powder, crushed chunks, slurry, melt or combination thereof.

In another aspect of the present invention a method for co-conversion of plastics and hydrocarbons into lighter distillate products is disclosed wherein the catalyst to hydrocarbon feedstock ratio is 3 to 25, preferably 5 to 20.

In another aspect of the present invention a method for co-conversion of plastics and hydrocarbons into lighter distillate products is disclosed wherein the waste plastic is in the range 0.1 to 15 wt %, preferably 0.5 to 5 wt % of the total feed mix (hydrocarbon and waste plastic).

In another aspect of the present invention a method for co-conversion of plastics and hydrocarbons into lighter distillate products is disclosed wherein the riser reactor is operated at the temperature range of 490 to 680° C., preferably 500 to 570° C. and pressure in range of 0.9 to 2 $Kg/cm^2$ (g) preferably 1.0 to 1.5 $Kg/cm^2$ (g).

In another aspect of the present invention a method for co-conversion of plastics and hydrocarbons into lighter distillate products is disclosed wherein the catalyst system comprises of Ultra-stable Y-zeolite in the range of 1 to 7 wt %, Pentasil zeolite in the range of 7 to 25 wt %, Bottom selective active material in the range of 0 to 10 wt %, rare earth constituents in the range of 0 to 1 wt % and remaining non-acidic constituents with binder.

In another preferred aspect of the present invention, a system for co-conversion of a waste plastics and hydrocarbons into light distillate products is disclosed, wherein the system comprising of:

(i) a waste plastic supply vessel (34) for
feeding waste plastic to bottom section of riser reactor (32);

(ii) riser reactor (32) for
receiving the waste plastic from waste plastic supply vessel (32) and;
receiving a hydrocarbon feed through the injection nozzles (31), and contacting them with hot regenerated catalyst;

(iii) regenerator vessel (45) for
feeding hot regenerated catalyst to riser reactor (32);

(iv) stripper vessel (41) for
separating hydrocarbon molecules from the catalyst by steam stripping and;

(v) fractionator column for.
separating product vapors (42) into Naphtha, Light cycle oil, Heavy cycle oil, clarified oil etc.

In another preferred aspect a method for co-conversion of plastics and hydrocarbons into lighter distillate products, wherein the waste plastic supply vessel (34) is kept under controlled pressure, by means of pressure control valve (40), in the range of 1-2.5 $Kg/cm^2$ g.

In another preferred aspect, the waste plastic supply vessel (34) has gas facility for gas injection by gas supply ring (36).

BRIEF DESCRIPTION OF THE DRAWING

To further clarify advantages and aspects of the invention, a more particular description of the invention will be rendered by reference to specific embodiments thereof, which is illustrated in the appended drawing(s). It is appreciated that the drawing(s) of the present invention depicts only typical embodiments of the invention and are therefore not to be considered limiting of its scope.

DESCRIPTION OF THE INVENTION

Figure 1:
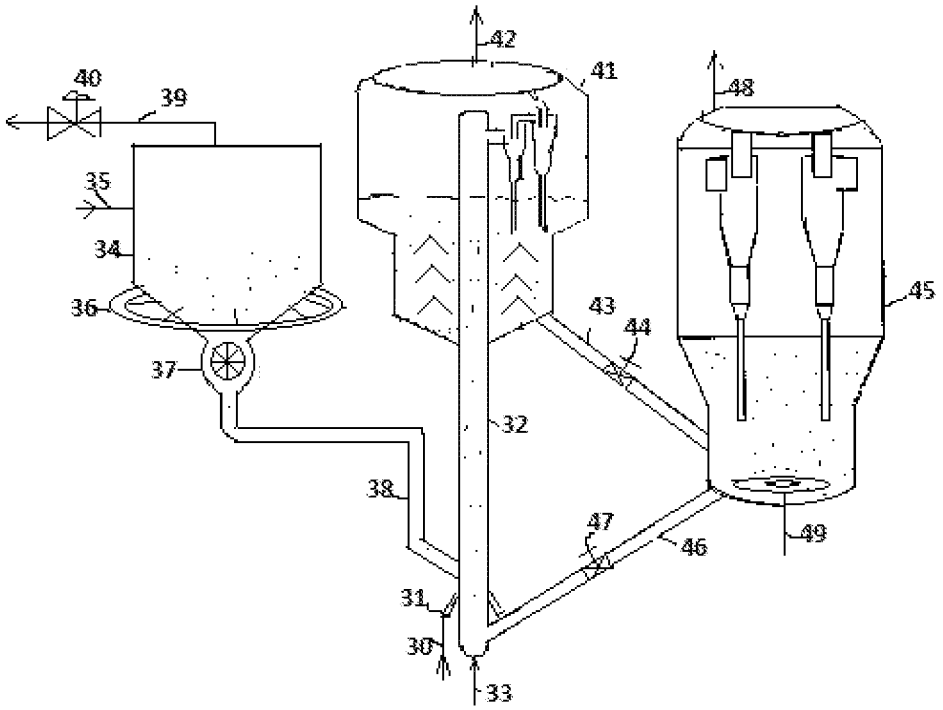
FIG. 1 illustrates schematic diagram of process of the present invention.

According to the main embodiment, the present invention discloses the process to convert low value plastic waste material, including metal containing polyethylene-polypropylene multilayer plastics into higher value lighter distillate products by co-processing along with petroleum-based hydrocarbon feedstocks in a catalytic cracking Unit.

In one of the embodiment, the present invention discloses a unique process hardware scheme to feed the waste plastic into the FCC directly. The crushed waste plastic material is loaded into a waste plastic supply vessel where it is kept in fluidized conditions and is supplied pneumatically to the bottom section of riser reactor of FCC through pneumatic conveying mechanism. The hydrocarbon feed is preheated in the temperature range of 150-350° C. The hydrocarbon feedstock is injected into a high velocity (>5 m/s) pneumatic flow riser type cracking reactor where it undergoes catalytic cracking upon contact with the hot micro sized catalyst particles coming at a temperature range of 650-750° C. supplied from a catalyst regenerator vessel. Waste plastics powder, as soon as it enters the bottom section it undergoes thermal cracking first taking heat from the hot regenerated catalyst particles, since the molecule size of waste plastics are larger compared to the micron sized catalysts. Once the comparatively smaller size molecules are produced from thermal decomposition, these molecules then will be able to contact with the catalyst particles effectively and can penetrate the pores of the catalyst which act as active sites for catalytic cracking. These molecules are subjected to catalytic cracking upon contact with the catalyst to produce further lighter hydrocarbon molecules like fuel gas, LPG, gasoline etc. while moving upwards the riser reactor. A combined lighter distillate product vapor produced by catalytic cracking of both petroleum hydrocarbon feedstock as well as waste plastics is then routed to the main fractionator column to separate into desired liquid product fractions like light cycle oil, clarified oil etc. The vapor products from the fractionator column top are routed to the GASCON section (gas separation and concentration section) for separation of naphtha, fuel gas and LPG.

Hydrocarbon Feedstock:

The liquid hydrocarbon feedstock to be used in the process is selected from hydrocarbon feedstocks like fractions starting from carbon number. of 5 in naphtha to vacuum gasoil, vacuum residue, atmospheric residue, deasphalted oils, shale oil, coal tar, clarified oil, residual oils, heavy waxy distillates, foots oil, slop oil or blends of such hydrocarbons having carbon Number. more than 100. The fractions could be straight run or cracked components produced by catalytic processes, as for example, hydrocracking, FCC or thermal cracking processes like coking, visbreaking etc. The Conradson carbon residue content of the feedstock is kept a maximum value of 11 wt % and minimum density of 0.95 g/cc.

Waste Plastic:

Plastics are macromolecules, formed by polymerization and having the ability to be shaped by application of reasonable amount of heat and pressure or another form of forces Plastic is a generic term for a wide range of polymers produced using highly refined fractions of crude oil, or chemicals derived from crude oil, known as monomers. Polymers are formed by the reaction of these monomers, which results in chain lengths of tens or hundreds of thousands of carbon atoms.

Due to its non-biodegradable nature, the plastic waste contributes significantly to the problem of waste management. Metals like aluminium, and tin are added into the plastics films for more durability. Examples for these include metal containing polyethylene and polypropylene multilayer plastics films, metal containing polyethylene terephthalate plastic films. The waste plastics are dosed in small quantities of less than 10 wt %, to minimize the detrimental effects on the catalyst due to deposition of residual metals on the catalyst while cracking and decomposition.

Plastics, depending upon their physical properties may be classified into thermoplastic or thermosetting plastic materials.

Thermoplastic materials (recyclable plastics): These can be formed into desired shapes under heat and pressure and become solids on heating. Examples are polythene, polystyrene and PVC.

Thermostats or thermosetting materials (non-recyclable plastics): These, once shaped, cannot be softened/remolded by the application of heat. Examples are phenol formaldehyde and urea formaldehyde.

The waste plastics which can be co-converted in the invented process includes a variety of plastics comprising polystyrene, polypropylene, polyethylene, PET etc. including metal additized multilayer plastics. These waste plastics to be used in the process can be pre-processed by steps comprising of washing, drying, extrusion, pelletization etc. In order to enable transfer of the same from plastic feeder vessel to the riser bottom, the waste plastics can be prepared with selected size and shape specifications to enable them to be in fluidizable form for enabling pneumatic transport.

In one feature of the present invention, the waste plastics are supplied from the plastic feeder vessel to the riser reactor bottom by using a conveyer such as screw conveyer.

In another embodiment of the present invention, the waste plastic material is kept in the plastic feeder vessel in the molten form by application of heat and is supplied to the riser in liquid form. In yet another embodiment of the invention, the waste plastics used for processing in the process of present invention can be in crushed form or as lumps which can be transported through other means like conveyer belts.

Catalyst:

Solid catalyst composition to be employed in the invention is: 1 to 7 wt. % of ultra-stable Y-zeolite; from 7 to 25 wt. % of pentasil zeolite which is shape selective; from 0 to 10 wt % of active material which is bottom selective; from 0 to 1 wt % of rare earth constituents; and from 60 to 85 wt % of non-acidic constituents and binder. The pore size of USY-zeolite is in the range of 8-11 Å; shape selective pentasil zeolite in the range of 5-6 Å; and bottom selective active material in the range of 50-950 Å. Conventional fluid catalytic cracking catalyst mainly consists of varieties of Y-zeolite as active ingredient to enable catalytic cracking reactions. Conventional catalyst systems used in the fluid catalytic cracking unit (FCCU)/resid fluid catalytic cracking unit (RFCCU) processes also can be employed for enabling the plastic conversion, but this will result in lower light olefin yields from the plastic.

Process Conditions:

The riser reactor of the process may be operated with desired operating temperature ranging from 490 to 680° C., preferably between 500° C. to 570° C. and desired operating pressure ranging from 0.9 to 2 $Kg/cm^2$ (g) preferably between 1.0 to 1.5 $Kg/cm^2$ (g). The weight hourly space velocity (WHSV) is maintained in the range of 40-120 $hr^{-1}$. The residence time provided in the riser reactor is kept in the range of 1 to 10 seconds, preferably between 3 to 7 seconds. Catalyst to hydrocarbon feedstock flow rate ratio may be kept between 3 to 25, preferably between 5 to 20. Waste plastic feeding quantity to the riser reactor may be kept between 0.1 to 15 wt %, preferably between 0.5 to 5 wt % in the total feed mix of hydrocarbon and waste plastic. Steam used for dilution and quenching of the hydrocarbons, is maintained in the range of 3-50% of the feed depending upon the quality of hydrocarbon feedstock.

Process Description:

The process of the present invention is exemplified by, but not limited to FIG. 1. In the process described in FIG. 1, the waste plastics granules are supplied to the plastic supply vessel (34) through a pneumatic conveying system, or a mechanical conveying system used typically for transport of waste plastic granules from a storage vessel. Waste plastics from plastic supply vessel (34) are supplied to the riser bottom section through a pipe (38) under the flow rate controlled by a rotary airlock valve (37). An option for inert gas injection by means of a gas supply ring (36) is provided in the plastic supply vessel (34) to avoid any choking. The plastic supply vessel is kept at desired pressure in the range of 1 to 2 $Kg/cm^2$ g, to enable pressure balance of the whole unit in operation by means of a pressure control valve (40) provided in the gas line (39). The hydrocarbon feed (30) enters the bottom of the riser reactor (32) through the injection nozzles (31) and sprayed inside the riser bottom section into micron sized droplets. These are contacted by the hot regenerated catalyst supplied to the riser bottom section through a regenerated catalyst standpipe (46) & slide valves (47) from a regenerator vessel (45). A lift fluidization media (33) is also supplied to the riser bottom. When the waste plastics enter the high temperature environment of the riser bottom section, initially the plastic material is thermally decomposed into lighter molecules. Then these molecules generated from thermal decomposition are catalytically cracked into further lighter hydrocarbon molecules by contacting with the catalyst particles during the upward motion of the catalyst and vapors in the riser. The catalyst and product vapors are separated at the end of the riser reactor by means of riser termination devices such as closed coupled cyclones well known in the art of FCC and the entrained hydrocarbon molecules are separated from the catalyst further by steam stripping in the stripper vessel (41). The product vapors (42) from top of the stripper vessel are routed to the main fractionator column (reference numeral?) for separation into different product fractions like naphtha, light cycle oil, heavy cycle oil, clarified oil etc. The steam stripped catalyst is dent to the regenerator vessel (45) through a spent catalyst standpipe (43), flow of which is controlled by the spent catalyst slide valve (44). The coke laden catalyst is regenerated in the regenerator vessel (45) by burning off the coke in the presence of air (49) supplied through distributor such as sparger systems well known in the art of FCC at the bottom section.

In an embodiment, the waste plastic is sent to the riser reactor in molten form.

In another embodiment, the waste plastic is sent to the riser bottom mixed with a solvent, which is selected from hydrocarbon solvents containing carbon number ranging from 5 to 100.

In yet another embodiment, the thermal energy from the hot regenerated catalyst from the regenerator vessel is used to melt the waste plastics.

Figure 2:
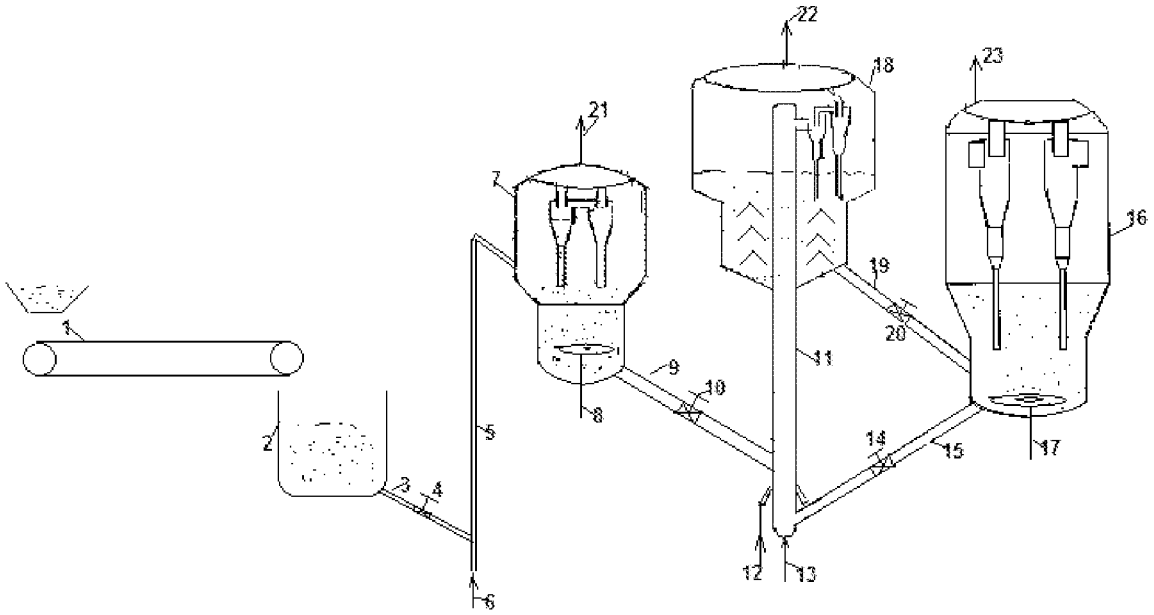
FIG. 2 illustrates schematic diagram of embodiment of process of the present invention.

A schematic of an embodiment of the process of present invention is provided in FIG. 2. In the process described in FIG. 2, the waste plastics powder/granules are supplied to the loading vessel (2) through a conveyer belt (1) or similar means. From the said vessel, waste plastics are taken out through a pipe (3) at the required rate by using a valve (4) such as 'rotary airlock valve'. The waste plastics are loaded into the plastic supply vessel (7) by using a loading line (5) assisted by a fluidization medium (6) which may be oriented in vertical or horizontal direction. The plastic material is kept in fluidized conditions in the plastic supply vessel (7) by means of a fluid supplied through a distributor (8). The gases (21) are taken out of the vessel by suitable means to ensure control of vessel pressure. The hydrocarbon feed (12) enters the bottom of the riser reactor (11) through the injection nozzles (31) and sprayed as micron sized droplets inside the riser bottom section. These are contacted by the hot regenerated catalyst supplied to the riser bottom section through a regenerated catalyst standpipe (15) with slide valves (14) from a regenerator vessel (16). A lift fluidization media (13) is also supplied to the riser bottom. Waste plastics from plastic supply vessel (7) are supplied to the riser bottom section through a pipe (9) provided with a flow rate control valve (10). When the waste plastics enter the high temperature environment of the riser bottom section, initially the plastic material is thermally decomposed into lighter molecules. Then these molecules generated from thermal decomposition are catalytically cracked into further lighter hydrocarbon molecules by contacting with the catalyst particles during the upward motion of the catalyst and vapors in the riser. The catalyst and product vapors are separated at the end of the riser reactor by means of riser termination devices and the entrained hydrocarbon molecules are separated from the catalyst by further steam stripping in the stripper vessel (18). The product vapors (22) from top of the stripper vessel are routed to the main fractionator column for separation into different product fractions like naphtha, light cycle oil, heavy cycle oil, clarified oil etc. The steam stripped catalyst is dent to the regenerator vessel (16) through a spent catalyst standpipe (19), flow of which is controlled by the spent catalyst slide valve (20). The coke laden catalyst is regenerated in the regenerator vessel (16) by burning off the coke in the presence of air (17) supplied to the regenerator.

Though the hardware process scheme of the present invention can be implemented in conventional fluid catalytic cracking units (FCCUs) and resid FCCUs, it is highly desirable to do so in high severity FCCUs considering the additional heat availability and the need for increasing catalyst circulation rate.

EXAMPLES

The process of the present invention is exemplified by following non-limiting example.

Waste plastic processing in the scheme of the present invention described in FIG. 1 was simulated by processing a mixed waste plastic of polyethylene and polypropylene waste from municipal solid waste. In order to demonstrate the phenomena of thermal cracking of waste plastic to liquid hydrocarbon and thereafter to light olefins, naphtha and middle distillates etc. through catalytic cracking, the waste plastic was subjected to thermal pyrolysis yielding 15 wt % gas (ethylene: 3.29 wt %, propylene: 41.81 wt %), 76 wt % liquid and 9 wt % coke residue. Further this oil along with hydrocarbon feedstock was subjected to catalytic cracking using a catalyst (catalyst-A) having 4 wt. % of ultra-stable Y-zeolite, 18 wt. % of pentasil zeolite, 10 wt % of active material which is bottom selective, 0.5 wt % of rare earth constituents and 67.5 wt % of non-acidic constituent binder.

The properties of hydrocarbon feedstock—hydrotreated VGO, are provided in Table-1.

TABLE 1

Properties of hydrocarbon feedstock

| Sample ID | CED 6753 |
|---|---|
| Density, g/cc | 0.8991 |
| CCR, wt % | 0.05 |
| Sulfur, ppmwt | 355.7 |
| Nitrogen, ppmwt | 159.7 |
| PONA & H2, wt % | |
| Aromatics | 19.3 |
| Olefins | — |
| Saturates | 80.7 |
| Hydrogen | 14 |

The operating conditions of the catalytic cracking experiments are provided as below in Table-2.

TABLE 2

Operating conditions of catalytic cracking

| Parameter | Unit | Value |
|---|---|---|
| Temperature | ° C. | 580 |
| WHSV | $hr^{-1}$ | 59.40 |
| Catalyst/Oil | — | 20 |

In order to check the catalytic conversion of waste plastic pyrolysis oil, a run was carried out with the properties as provided in Table-3 and the yields are provided in Table-4.

TABLE 3

| Properties of waste plastic pyrolysis oil | | |
|---|---|---|
| Property | Unit | Value |
| Sulfur | ppm | 385 |
| Asphaltene | ppm | <100 |
| Compound class (NMR) | | |
| Olefins | wt % | 66 |
| Aromatics | wt % | 34 |
| Metal Analysis | | |
| Fe/Ni/V/Na/Ti/Ca | wppm | 49/<2/<2/<2/<2/<2 |
| Distillation (ASTM D2887), wt % | ° C. | |
| IBP | ° C. | 169 |
| 10% | ° C. | 180 |
| 40% | ° C. | 222 |
| 60% | ° C. | 259 |
| 80% | ° C. | 332 |
| 90% | ° C. | 385. |
| 95% | ° C. | 424 |
| FBP | ° C. | 476 |

TABLE 4

| Yield patterns for catalytic conversion of pyrolysis oil | |
|---|---|
| Run | 1 |
| Product yields, wt % | |
| Dry gas (except C2=) | 2.17 |
| Ethylene (C2=) | 6.02 |
| LPG (except C3=) | 11.1 |
| Propylene (C3=) | 15.3 |
| Gasoline C5-210° C. | 52.50 |
| Light cycle oil, 210-360° C. | 7.56 |
| CLO, 360° C. | 0.74 |
| Coke | 4.6 |

The comparison of yield patterns (total fresh feed basis—Hydrocarbon & Waste plastic) from different runs with waste plastic co-processing is provided in Table-5.

TABLE 5

| Yield patterns for plastic co-conversion with hydrocarbon feedstock | | | |
|---|---|---|---|
| Run | 2 | 3 | 4 |
| Plastic dosing, wt % | 0 | 6.5 | 13 |
| Product yields, wt % | | | |
| Dry gas (except C2=) | 2.97 | 3.01 | 3.06 |
| Ethylene (C2=) | 7.05 | 6.92 | 6.79 |
| LPG(except C3=) | 19.5 | 19.19 | 18.88 |
| Propylene (C3=) | 20 | 19.86 | 19.73 |
| Gasoline C5-210° C. | 30.02 | 30.66 | 31.30 |
| Light cycle oil, 210-360° C. | 13.12 | 12.66 | 12.18 |
| CLO, 360° C. | 4.16 | 3.91 | 3.69 |
| Coke | 3.18 | 3.79 | 4.37 |

It could be seen that there is no significant deterioration due to processing of waste plastic in the process scheme of present invention and also that there is appreciable conversion of the plastic to lighter hydrocarbons.

Advantages of the Invention

1. Uses majority of the existing fluid catalytic cracking hardware with few additional vessels as major hardware to convert the waste plastics including metal containing polyethylene and polypropylene multi-layer plastics films into valuable lighter distillate products.
2. Enables the refiner to generate value from the waste plastics and address the environmental concerns of metal containing waste plastic disposal.
3. Solves the problem of heat supply for waste plastic conversion and minimizes the detrimental effects of metal deposition on cracking catalysts during metal containing waste plastic conversion.
4. Addresses the issue of heat removal from the regenerator vessel of the fluid catalytic cracking unit while using the same for carrying out cracking of waste plastics.
5. Enables the operation of fluid catalytic cracking unit at higher catalyst flow rate by heat balance.
6. Addresses the issue of treatment of reaction products from waste plastic cracking by enabling the treatment of the same along with the conventional reaction products of hydrocarbon feed catalytic cracking, thereby ensuring product quality.
7. Eliminates issues like choking of feed nozzles, feed furnace etc. while mixing of plastic in the hydrocarbon feedstock as being attempted in conventional co-processing of feedstocks.
8. Enables catalytic conversion of decomposition products of waste plastics like naphtha molecules to further lighter products like LPG and light olefins like ethylene and propylene.

What is claimed is:

1. A method for co-conversion of waste plastics and hydrocarbons into lighter distillate products, the method comprising:

a) spray feeding a hydrocarbon feed in a bottom section of a riser reactor through injection nozzles;

b) feeding hot regenerated catalyst from a regenerator vessel into the bottom section of the riser reactor to allow contacting with the hydrocarbon feed;

c) feeding a lift fluidization media into the bottom section of the riser reactor;

d) conveying a waste plastic from a supply vessel to the bottom section of the riser reactor, to allow thermal decomposition of the waste plastic into lighter molecules and catalytic cracking of the same by contacting with the hot regenerated catalyst during an upward motion through the riser reactor, wherein the waste plastic comprises metal containing polyethylene-polypropylene multilayer plastics;

e) separation of the hot regenerated catalyst and product vapors by means of riser termination devices;

f) separation of hydrocarbon molecules from the catalyst by steam stripping in a stripper vessel; and g) separation of the product vapors into different product fractions comprising Naphtha, Light cycle oil, Heavy cycle oil, clarified oil by a fractionator column.

2. The method as claimed in claim 1, wherein the waste plastic is pre-processed by steps comprising washing, drying, extrusion, and pelletization.

3. The method as claimed in claim 1, wherein the waste plastic in the supply vessel is in fluidized conditions.

4. The process as claimed in claim 1, wherein a physical form of the waste plastic is selected from the group consisting of granules, powder, crushed chunks, slurry, melt and a combination thereof.

5. The process as claimed in claim 1, wherein the catalyst to the hydrocarbon feed ratio is 3 to 25.

6. The process as claimed in claim 1, wherein the waste plastic is in a range of 0.1 to 15 wt % of a total feed mix, wherein the total feed mix comprises the hydrocarbon feed and the waste plastic.

7. The process as claimed in claim 1, wherein the riser reactor is operated at a temperature in a range of 490° C. to 680° C., and a pressure in a range of 0.9 to 2 $Kg/cm^2$ (g).

8. The process as claimed in claim 1, wherein the catalyst comprises an ultra-stable Y-zeolite in a range of 1 to 7 wt %, pentasil zeolite in a range of 7 to 25 wt %, a bottom selective active material in a range of 0 to 10 wt %, rare earth constituents in a range of 0 to 1 wt % and remaining non-acidic constituents with a binder.

9. A system for co-conversion of waste plastics and hydrocarbons into light distillate products, the system comprising:

(i) a waste plastic supply vessel for feeding a waste plastic to a bottom section of a riser reactor, wherein the waste plastic comprises metal containing polyethylene-polypropylene multilayer plastics;

(ii) the riser reactor for receiving the waste plastic from the waste plastic supply vessel and receiving a hydrocarbon feed through injection nozzles, and contacting them with a hot regenerated catalyst;

(iii) a regenerator vessel for feeding the hot regenerated catalyst to the riser reactor;

(iv) a stripper vessel for separating hydrocarbon molecules from the catalyst by steam stripping; and (v) a fractionator column for separating product vapors into naphtha, light cycle oil, heavy cycle oil, and clarified oil.

10. The system as claimed in claim 9, wherein the waste plastic supply vessel is kept under a controlled pressure, by means of a pressure control valve, in a range of 1-2.5 $Kg/cm^2$(g).

11. The system as claimed in claim 9, wherein the waste plastic supply vessel has a gas facility for a gas injection by a gas supply ring.

* * * * *